US008048263B2

(12) United States Patent
Herkel et al.

(10) Patent No.: US 8,048,263 B2
(45) Date of Patent: Nov. 1, 2011

(54) FOUR STAGE ALKALINE PEROXIDE MECHANICAL PULPINGS

(75) Inventors: Martin Herkel, Vienna (AT); Thomas Pschorn, Lennoxville (CA); Eric Chao Xu, Miamisburg, OH (US)

(73) Assignee: Andritz Inc., Muncy, PA (US)

( * ) Notice: Subject to any disclaimer, the term of this patent is extended or adjusted under 35 U.S.C. 154(b) by 0 days.

(21) Appl. No.: 12/661,909

(22) Filed: Mar. 26, 2010

(65) Prior Publication Data

US 2010/0186910 A1 Jul. 29, 2010

Related U.S. Application Data

(63) Continuation of application No. 10/483,648, filed as application No. PCT/US02/23078 on Jul. 19, 2002, now abandoned.

(60) Provisional application No. 60/306,974, filed on Jul. 19, 2001.

(51) Int. Cl.
*D21C 9/16* (2006.01)

(52) U.S. Cl. ..... 162/25; 162/26; 162/56; 162/78

(58) Field of Classification Search ..... 162/25–26, 162/70, 72, 78, 80
See application file for complete search history.

(56) References Cited

U.S. PATENT DOCUMENTS

| | | | | |
|---|---|---|---|---|
| 3,023,140 | A | 2/1962 | Textor | |
| 4,040,743 | A | 8/1977 | Villaume et al. | |
| 4,187,141 | A | 2/1980 | Ahrel | |
| 4,270,976 | A | 6/1981 | Sandstrom et al. | |
| 4,294,653 | A | 10/1981 | Lindahl et al. | |
| 4,311,553 | A | 1/1982 | Akerlund et al. | |
| 4,486,267 | A | 12/1984 | Prusas | |
| 4,718,980 | A | 1/1988 | Lowrie et al. | |
| 4,756,799 | A | 7/1988 | Bengtsson et al. | |
| 4,849,053 | A | 7/1989 | Gentile et al. | |
| 4,900,399 | A | 2/1990 | Bengtsson et al. | |
| 5,776,305 | A * | 7/1998 | Sabourin | 162/23 |
| 6,458,245 | B1 * | 10/2002 | Hoglund et al. | 162/149 |
| 6,743,332 | B2 | 6/2004 | Haynes et al. | |
| 6,881,299 | B2 | 4/2005 | Parrish et al. | |
| 7,758,720 | B2 * | 7/2010 | Sabourin | 162/28 |
| 7,758,721 | B2 * | 7/2010 | Sabourin | 162/28 |
| 7,892,400 | B2 * | 2/2011 | Sabourin | 162/261 |
| 2001/0050151 | A1 | 12/2001 | Sabourin | |
| 2004/0069427 | A1 * | 4/2004 | Xu | 162/78 |
| 2004/0200586 | A1 * | 10/2004 | Herkel | 162/25 |
| 2005/0011622 | A1 * | 1/2005 | Sabourin | 162/26 |
| 2008/0035286 | A1 * | 2/2008 | Aichinger et al. | 162/24 |
| 2008/0066877 | A1 * | 3/2008 | Sabourin | 162/23 |
| 2008/0105391 | A1 * | 5/2008 | Sabourin | 162/18 |
| 2008/0142181 | A1 * | 6/2008 | Sabourin | 162/315 |
| 2009/0151880 | A1 * | 6/2009 | Aichinger et al. | 162/23 |
| 2009/0288789 | A1 * | 11/2009 | Sabourin et al. | 162/24 |
| 2010/0186910 | A1 * | 7/2010 | Herkel et al. | 162/26 |
| 2010/0224333 | A1 * | 9/2010 | Duggirala et al. | 162/26 |
| 2010/0263815 | A1 | 10/2010 | Xu | |
| 2010/0269994 | A1 * | 10/2010 | Pranovich et al. | 162/83 |

FOREIGN PATENT DOCUMENTS

| | | |
|---|---|---|
| CA | 1 078 558 | 6/1980 |
| CA | 1 173 604 | 9/1984 |
| JP | 2008045262 A * | 2/2008 |
| SE | 226 593 | 7/1968 |
| SE | 7502059-4 | 8/1976 |
| SE | 454 185 | 4/1988 |
| WO | 95/34711 | 12/1995 |
| WO | 03/008703 | 1/2003 |
| WO | WO 2005042830 A1 * | 5/2005 |

OTHER PUBLICATIONS

Office Action mailed May 6, 2011 issued in co-pending U.S. Appl. No. 12/661,907.

G. A. Smook, Handbook for Pulp and Paper Technologists, 2nd ed., Angus Wilde Publications, 1992, p. 98.

Strunk, W. G. and Meng, T., "Status Report: Pulp Bleaching with Hydrogen Peroxide During Refining", Pulp and Pater 60 (11), 1986.

Xu, E.C., Sabourin, M.J., and Cort, J.B., "Evaluation of APMP and BCTMP Processes for Market Pulp Properties from South American Eucalyptus Species", 1996 Tappi Pulping Conference Proceedings, p. 705.

Xu, E.C., "Chemical Treatment in Mechanical Pulping, Part 1: South American Eucalyptus (Process and Properties)", 1997 Tappi Pulping Conference Proceedings, p. 985.

Xu, E.C., "Chemical Treatment in Mechanical Pulping, Part 2: North American Aspen (Process and Properties)". 1998 CPPA Technical Section Annual Meeting Proceedings, p. B51.

Xu, E.C., "Chemical Treatment in Mechanical Pulping, Part 3: Pulp Yield and Chemical Pretreatment". 1998 Tappi Pulping Conference Proceedings, p. 391.

Xu, E.C., "Properties and Papermaking Potential of APMP Pulp from Acacia Mangium", 52nd APPITA Annual General Conference Proceedings, (Brisbane, Australia, May 11-16, 1998), pp. 501-508.

(Continued)

*Primary Examiner* — Jose A Fortuna
(74) *Attorney, Agent, or Firm* — Nixon & Vanderhye P.C.

(57) ABSTRACT

A process for applying chemicals, such as an alkaline peroxide pretreatment (1) to lignocellulosic material before chemical refining and at the primary refiner (3). The preferred embodiment comprises (i) preconditioning at temperatures below 95° C., especially below 80° C., (ii) limiting the time and/or temperature in the refiner, (iii) reaction quench to maintain temperatures below 80° C., and (iv) subsequent high consistency bleaching (4).

32 Claims, 12 Drawing Sheets

OTHER PUBLICATIONS

Sferraza, M.J. And Bohn, W.L., Alkaline Peroxide Mechanical Pulping: The Pulp of the 1990's, 22nd ABTCP Pulp and Paper Annual Meeting, (San Paulo, Brazil, Nov. 20-24, 1989.

Gentile, V.M., Tschichirner, U., and Wilder, H.D., "The Scott Paper Alkaline Peroxide High Yielding Pulping Process". 1991 International Mechanical Pulping Conference Proceedings, p. 199.

Heitner, C., Beatson, R.P., and Atack, D., "Ultra-High Yield Pulping Part V: High Compression Impregnation of Softwood Chips with Sodium Sulphite—A Method of Producing CMP with High Wet and Dry Strength", paperi ja Puu (8): 417 1985.

Sharpe, P.E., and Rothenburg, I., "Refiner Hydrogen Peroxide Bleaching of Thermomechanical Pulps", Tappi Journal 71 (5): 109, 1988.

Springer, R., Huang, Y., Davies, D., Kronis, J., and Heimburger, S., "Refiner Peroxide Bleaching at Daishowa Port Angeles", 84th CPPA Annual Meeting Proceedings, p. A11.

Marton, R., Geoff, S., Brown, A.F., and Granzow, S., "Harwood TMP and RMP Modifications", Tappi Journal 62:1, p. 49, 1979.

Bohn, W and Sferrazza, M., "Alkaline peroxide mechanical pulping: a revolution in high yield pulping", 1989 International Mechanical Pulping Conference Proceedings, Helsinki, Finland.

Cannell, E. and Cockran, R., "The future of BCTMP", Pulp and Paper, May 2000, pp. 61-76.

Sabourin, M. and Presley, J., Low chemical alkaline peroxide TMP—a means for upgrading newsprint mills; 1992 Tappi Pulping Conference Proceeding, Book 3, pp. 1135-1114.

Heimburger, S., Quick, T., Sabourin, M., Trmblay, S., and Shaw, G., "One and two stage AP-TMP—a route to high brightness pulp", Tappi Journal, vol. 79: No. 8, pp. 139-144, 1996.

Xu, E.C., "Mechanical Pulping of South American Eucalyptus—Technology, Pulp Properties and Application Potential", 1st ABTCP Pulping Technology Conference—San Paulo, Brazil, May 5-7, 1998.

Xu, E.C., "A New Concept in Alkaline Peroxide Mechanical Pulping", 1999 International Mechanical Pulping Conference Proceedings, Houston, May 24-26, 1999, p. 5A-3.

Xu, E.C., "A New Technology for Utilization of South American Eucalyptus in Paper and Board Manufacture", 32nd ABTCP Annual Conference, Sao Paulo, Brazil, Oct. 18-21, 1999.

Xu, E.C., "P-RC Alkaline Peroxide Mechanical Pulping of Hardwood Part 1—Aspen, Beech, Birch, Cottonwood and Maple" PATAC annual meeting proceedings, Montreal 2000.

Xu, E.C., "P-RC APMP Pulps from Asian Tropical Hardwoods", Asia Paper conference proceeding, Singapore, Apr. 23-27, 2000.

Xu, E.C., "Process Selection for Chemical Mechanical Pulping of Aspen" PAPTAC Annual Meeting Montreal, Jan. 29-Feb. 2001.

Xu, E.C., "P-RC APMP Pulping of Hardwood and its Comparison with Chemical Pulping", Intl. Symp. Environmentally Friendly and Emerging Technologies for a sustainable pulp and Paper Industry Conf. Proceeding, Taiwan, Apr. 25-27, 2000.

* cited by examiner

Figure 2

| SAMPLE | A2 | A3 | A4 | A10 | A11 | A12 | A14 | A15 | A16 |
|---|---|---|---|---|---|---|---|---|---|
| Chem. Applied: | Chip + Refiner | | | Chip | | | Refiner | | |
| % T.A. | 3.4 | | | 3.3 | | | 4.2 | | |
| % $H_2O_2$ | 2.6 | | | 2.4 | | | 3.3 | | |
| Residual: | | | | | | | | | |
| % $H_2O_2$ | 0.29 | | | 0.25 | | | 0.48 | | |
| pH | 8.2 | | | 8.6 | | | 8.2 | | |
| Total SEC (kwh/odmt)(a) | 947 | 1223 | 1543 | 874 | 1181 | 1531 | 1127 | 1389 | 1729 |
| CSF (mL) | 481 | 338 | 223 | 436 | 340 | 225 | 537 | 436 | 266 |
| TENSILE INDEX (N.m/g) | 16.4 | 21.9 | 29.3 | 18.4 | 25.1 | 31.1 | 11.4 | 17.1 | 24.9 |
| BULK (cm3/g) | 3.13 | 2.81 | 2.47 | 3.16 | 2.78 | 2.51 | 3.58 | 3.13 | 2.63 |
| BURST INDEX (kPa.m2/g) | 0.56 | 0.77 | 1.16 | 0.68 | 1.04 | 1.27 | 0.43 | 0.64 | 1.03 |
| TEAR INDEX (mN.m2/g) | 2.7 | 3.0 | 4.1 | 3.5 | 3.6 | 4.4 | 2.3 | 2.7 | 3.3 |
| T.E.A. (J/m2) | 5.7 | 9.0 | 15.5 | 7.2 | 11.9 | 16.7 | 3.2 | 6.5 | 11.3 |
| ISO BRIGHTNESS | 76.8 | 78.0 | 78.3 | 74.6 | 75.2 | 74.6 | 76.7 | 77.5 | 78.1 |
| % OPACITY | 84.4 | 85.2 | 86.8 | 85.0 | 85.6 | 85.3 | 83.7 | 86.1 | 86.3 |
| SCATT. COEFF. (m2/kg) | 50.7 | 53.4 | 57.7 | 49.2 | 52.3 | 52.7 | 48.4 | 53.3 | 57.1 |

Note: a) A commercial APMP system normally useds about 70% or less SEC than the lab.

Figure 9

| Aspen | Atmospheric | Pressurized |
|---|---|---|
| *First Stage Impregnation* | | |
| % DTPA | 0.2 | 0.2 |
| *Second Stage Impregnation* | | |
| % TA | 3.7 | 3.9 |
| % $H_2O_2$ | 3.3 | 3.0 |
| % Silicate | 3.4 | 3.3 |
| % $MgSO_4$ | 0.1 | 0.1 |
| *Primary Refiner* | | |
| Casing Pressure (kPa) | 0.0 | 140 |
| % TA | 1.8 | 2.0 |
| % $H_2O_2$ | 2.5 | 2.4 |
| % Silicate | 2.4 | 2.6 |
| % MgSO4 | 0.10 | 0.1 |
| *Final Pulp* | | |
| Brightness (% ISO) | 84.2 | 84.7 |
| pH Residual | 8.8 | 9.0 |
| % TA Residual | 0.3 | 0.5 |
| % $H_2O_2$ Residual | 2.1 | 1.5 |
| Total TA Consumed (%) | 5.2 | 5.4 |
| Total $H_2O_2$ Consumed (%) | 3.7 | 3.9 |

Figure 10

| Birch | Atmospheric | Pressurized |
|---|---|---|
| *First Stage Impregnation* | | |
| % DTPA | 0.2 | 0.2 |
| *Second Stage Impregnation* | | |
| % TA | 2.0 | 2.0 |
| % $H_2O_2$ | 2.3 | 2.3 |
| % Silicate | 2.4 | 2.4 |
| % $MgSO_4$ | 0.1 | 0.1 |
| *Primary Refiner* | | |
| Casing Pressure (kPa) | 0 | 140 |
| % TA | 1.3 | 1.3 |
| % $H_2O_2$ | 1.8 | 1.7 |
| % Silicate | 1.8 | 1.7 |
| % MgSO4 | 0.1 | 0.1 |
| *Final Pulp* | | |
| Brightness (% ISO) | 82.4 | 82.6 |
| pH Residual | 8.0 | 8.0 |
| % TA Residual | 0.2 | 0.1 |
| % $H_2O_2$ Residual | 0.5 | 0.6 |
| Total TA Consumed (%) | 3.1 | 3.2 |
| Total $H_2O_2$ Consumed (%) | 3.6 | 3.4 |

FOUR STAGE ALKALINE PEROXIDE MECHANICAL PULPINGS

REFERENCE TO RELATED APPLICATIONS

The present application is a continuation of U.S. application Ser. No. 10/483,648 filed Jan. 13, 2004, now abandoned, which is the National Stage of International Application PCT/US2002/23078 filed Jul. 19, 2002, which claims benefit under 35 U.S.C. §119(e) of U.S. Provisional Application No. 60/306,974 filed Jul. 19, 2001.

FIELD OF THE INVENTION

The present invention relates to a process for the production of pulp from lignocellulosic material, such as wood chips or the like, by alkaline peroxide mechanical refining.

BACKGROUND OF THE INVENTION

Applying alkaline peroxide chemicals as part of refiner mechanical pulping may be traced back as early as 1962. Since then, there have been a number of different process ideas developed to apply the chemicals before or during early stages of refiner pulping. In recent years, an extensive and systematic investigation has been reported on how different chemical treatments in refiner mechanical pulping affect pulp property development and the process consumption. For hardwoods, it was observed that alkaline peroxide pretreatment in general gives better optical properties, better bleachability and higher pulp yield at similar strength properties when compared to other conventional chemical pretreatment, such as alkaline sulfite and cold caustic soda processes. When compared to a peroxide post-bleaching process, applying alkaline peroxide before refining has a tendency to give a higher bulk at a given tensile strength for some hardwood species, such as North American aspen.

In a very broad sense, alkaline peroxide refiner mechanical pulping is a type of pulping process where hydrogen peroxide and alkali in various forms, together with various amounts of different peroxide stabilizers, are applied to the lignocellulosic materials before or during defiberization and fibrillation in a refiner. In the early stage of development of this type of pulping process, there were two basic concepts. One was to apply alkaline peroxide treatment on chips, to allow the bleaching reactions to complete or to approach completion before refining. The other basic concept was to apply all the alkaline peroxide at the refiner, either with no pretreatment or with stabilizers or other alkaline pretreatment prior to the alkaline peroxide application at the refiner.

SUMMARY OF THE INVENTION

The invention, referred to herein as P-RC (Preconditioning followed by Refiner Chemical treatment), combines the concept of applying chemicals such as alkaline peroxide pretreatment to lignocellulosic material before primary refining with the concept of applying chemicals such as alkaline peroxide at the primary refiner.

This is achieved in the preferred embodiment, by a four stage process comprising (i) raw material preconditioning at temperatures below 95° C., especially below 80° C., (ii) time and/or temperature limited in-refiner reaction, (iii) reaction quench to maintain temperatures below e.g., 80° C., and (iv) subsequent high consistency bleaching.

An aspect of the invention is to apply a portion of the alkaline peroxide (and/or other chemicals known in the art to bleach or otherwise process lignocellulosic material into pulp or precursors of pulp) at the primary refiner in combination with upstream chip chemical impregnation step and/or steps, to yield a more efficient process in regard to energy reduction and bleaching than the application of all the chemicals either at the chip impregnation or at the refiner.

Another aspect of the invention is to achieve a better efficiency by moving a greater number of chemical reactions to the refining stage through the introduction of chemicals and/or chemical stabilizers at pretreatment in combination with addition of chemicals and/or chemical stabilizers at the primary refiner.

A further aspect of the invention is to improve or simplify the pulping process, engineering and operation, with a configuration to reduce or eliminate detrimental effects of increased temperature and/or other conditions or factors prior to and during primary refining which operate to influence pulp brightness development and $H_2O_2$ or other chemical efficiency.

A still further aspect of the invention is to improve or simplify the pulping process, engineering and operation, with a configuration to reduce or eliminate detrimental effects of increased temperature and/or other conditions or factors during or subsequent to discharge from the primary refiner casing which operate to influence pulp brightness development and $H_2O_2$ or other chemical efficiency.

BRIEF DESCRIPTION OF THE DRAWINGS

The invention will be better understood by reference to the accompanying drawing in which:

FIG. 2 is a table comparing the invention with two prior art processes.

FIG. 9 is a comparative table of atmospheric versus pressurized casing processing of aspen wood chips according to the invention.

FIG. 10 is a comparative table of atmospheric versus pressurized casing processing of birch wood chips according to the invention.

DETAILED DESCRIPTION OF THE INVENTION

Figure 1:
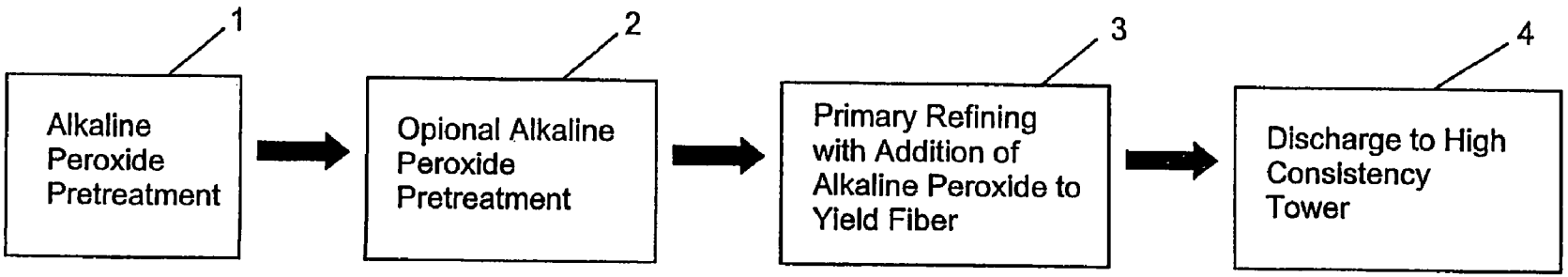
FIG. 1 is a block diagram consistent with an embodiment of the invention, depicting the general P-RC APMP process.
Figure 1A:
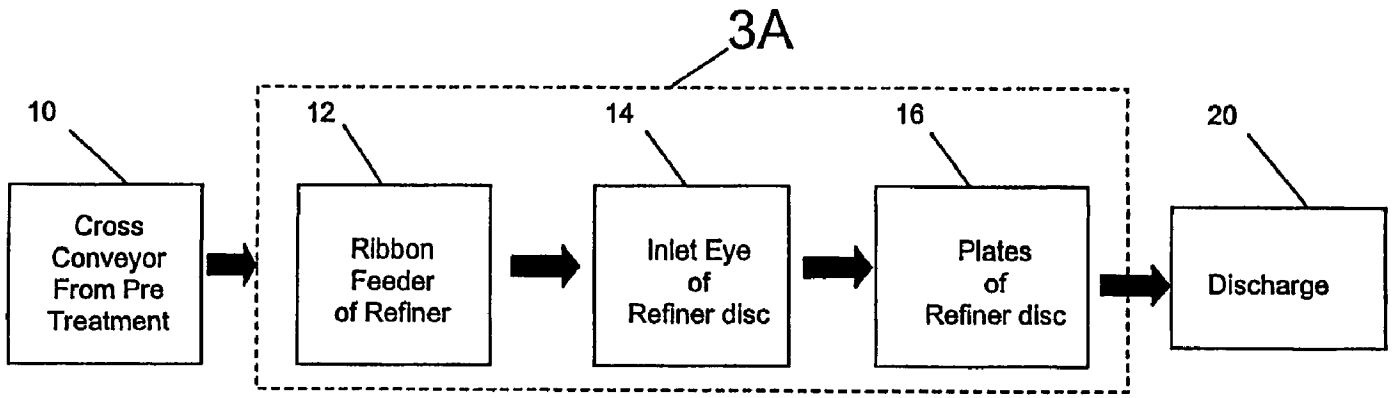
FIG. 1A is a block diagram consistent with an embodiment of the invention, depicting steps of transferring lignocellulosic material to a refiner having a casing at atmospheric pressure, with discharge at atmospheric pressure.
Figure 1B:
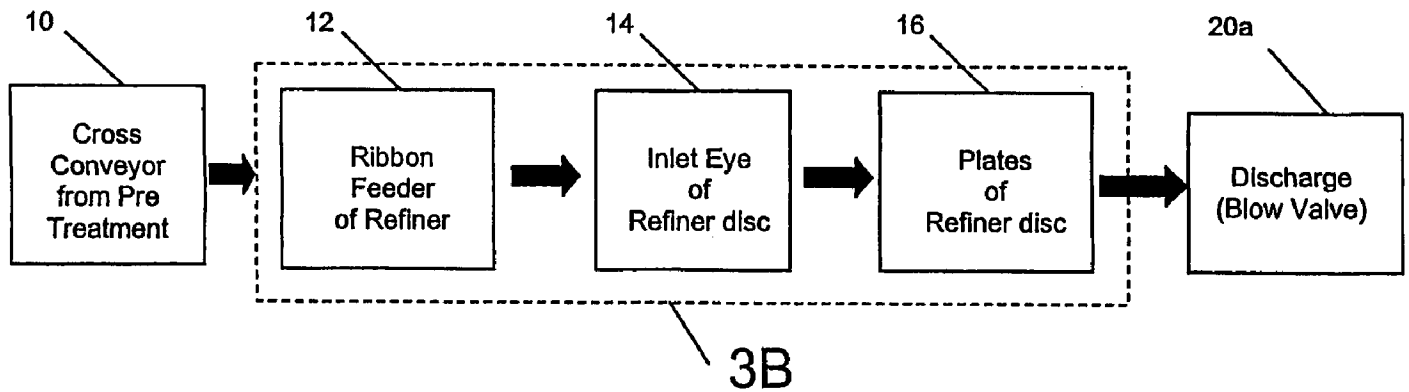
FIG. 1B is a block diagram consistent with an embodiment of the invention, depicting steps of transferring lignocellulosic material to a refiner having a pressurized casing with pressurized discharge.

FIG. 1 presents a simplified process flow diagram of an embodiment of the inventive P-RC alkaline peroxide mechanical pulping (APMP) process. The P-RC process generally applies alkaline peroxide chemicals at chip pretreatment/chip impregnation step(s)/stage(s) 1, 2 and as the material is fed to the primary refiner 3. As will be described more fully below, in the preferred embodiment, the invention has four stages, (i) raw material preconditioning at temperatures below 95° C., especially below 80° C., (ii) time and/or temperature limited in-refiner reaction, (iii) reaction quench to maintain temperatures below e.g., 80° C., and (iv) subsequent high consistency bleaching.

The preconditioning step(s) (i) as implemented in stages 1 and 2 of FIG. 1, preferably include one or two atmospheric compression devices, such as screw presses. Chip material is fed through an inlet, and passes through at least one compression region and at least one expansion region, and is discharged. A chemically active solution (pretreatment solution) is added to the material, typically while decompressing or decompressed at or near the discharge to facilitate penetration of the solution into the material.

The refiner 3 for implementing step (ii) is a primary refiner of conventional size, configuration, and operating conditions as known for chemi-mechanical pulping, subject, however, to care in operation so as not to expose the alkaline peroxide to excessive temperature or time-temperature combination. The chemicals added at the refiner will be referred to as the refiner solution.

Steps (iii) and (iv) are implemented following the primary refining, with a relatively high level of chemical presence carried over from the refiner, while maintaining temperature control to avoid premature degradation of the post-refining chemical activity.

FIGS. 1A through 1F present various non-limiting embodiments of the P-RC process. For example, FIGS. 1A and B show that after the material is pretreated at 1 and/or 2, addition of the solution to the lignocellulosic material may more specifically occur at a cross conveyer 10, downstream of the screw press and near refiner 3, or at the refiner itself, e.g., the ribbon feeder 12, the inlet eye of the refiner disc 14, and/or at the inlet zone of the plates on the refiner disc 16. As used herein, chemical addition "as the material is fed to the refiner", encompasses the locations 10, 12, 14, and 16. The refiner may have an atmospheric casing 3A or an overpressure casing 3B, but the inlet to the refiner would normally be at atmospheric pressure. The discharge from a pressurized casing 20*a* of primary pulp may be through a blow valve or similar device, and discharge from an atmospheric casing 20 may be by gravity drop or the like. The discharge from the refiner will, in any event, directly or indirectly go to a high consistency-bleaching tower 24 of any type known in the art (but subject to temperature control).

The pretreatment and refiner solutions act chemically on the lignocellulosic material, as it is refined to primary pulp. It may be advantageous, depending on the lignocellulosic material and the processing equipment, to modify the chemical exposure profile of the material to the chemical agents in order to optimize the process, and/or eliminate or reduce unwanted chemical effects or degradation. Such chemical profile modification may be accomplished by sequential chemical additions throughout the process, and can be combined with other variable conditions such as temperature, concentration, pressure, and duration to further enhance the desired effect.

Figure 1C:
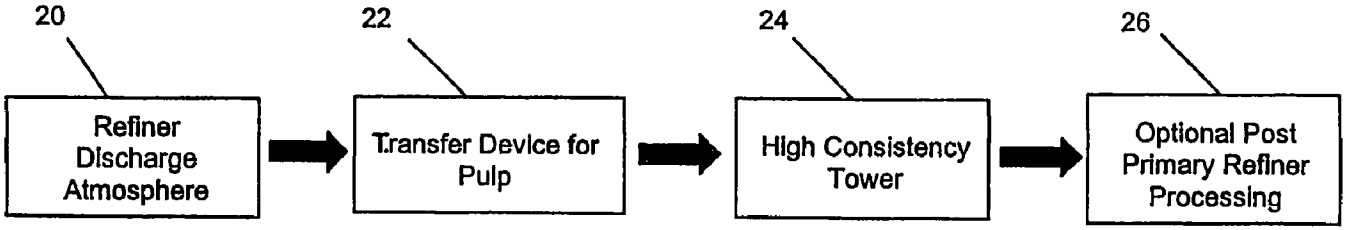
FIG. 1C is a block diagram consistent with an embodiment of the invention, depicting steps of transferring primary pulp produced in the refiner with a casing at atmospheric pressure, to a high consistency tower via a transfer device.
Figure 1D:
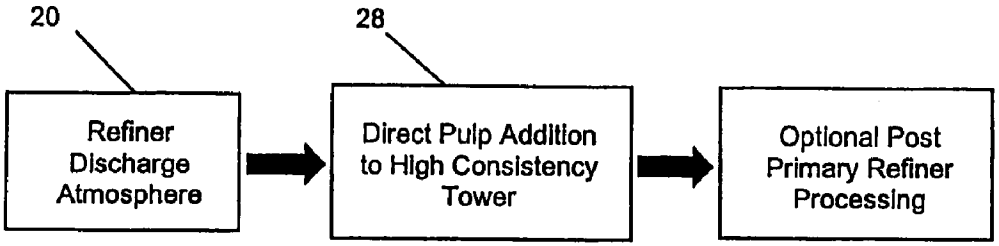
FIG. 1D is a block diagram consistent with an embodiment of the invention, depicting steps of transferring primary pulp produced in the refiner with a casing at atmospheric pressure directly to a high consistency tower.
Figure 1E:
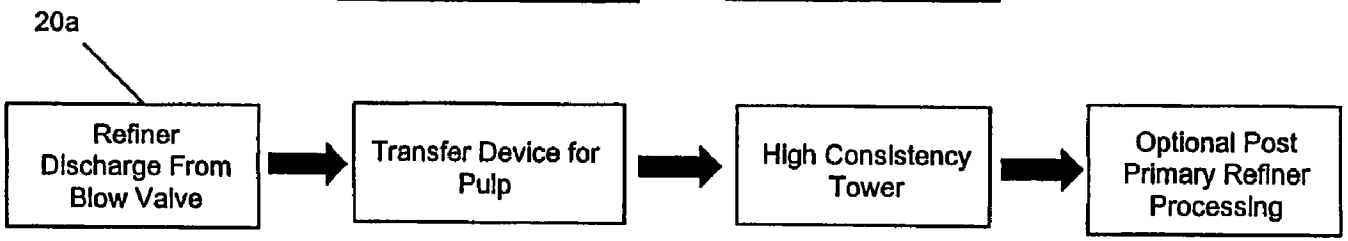
FIG. 1E is a block diagram consistent with an embodiment of the invention, depicting steps of transferring primary pulp produced in the refiner with a pressurized casing, to a high consistency tower via a transport device.
Figure 1F:
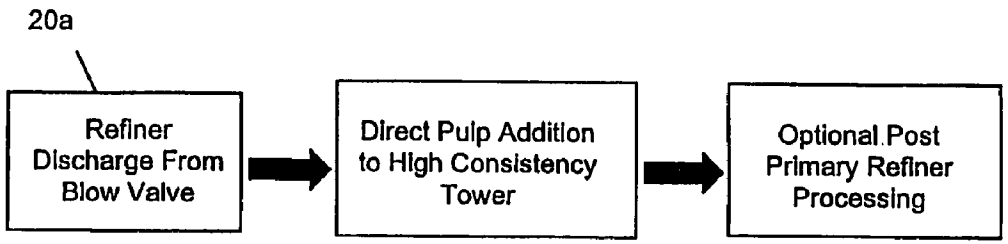
FIG. 1F is a block diagram consistent with an embodiment of the invention, depicting steps of transferring primary pulp produced in the refiner with a pressurized casing to a high consistency tower, directly by blowing.

Lignocellulosic material processed using the P-RC process is discharged 4 from the primary refiner casing (either atmospheric discharge 20 or overpressure discharge 20*a*), as a primary pulp having a measurable freeness and could properly be called a pulp able to form a handsheet. As shown in FIGS. 1C and D, atmospheric discharge from the refiner could pass via a transfer device 22 such as a transfer screw, to the tower 24, or more directly 28 via a chute or the like. As shown in FIGS. 1E and F, with a pressurized casing the refined pulp would typically be discharged through a blow valve and delivered either directly or indirectly to the tower. Optionally, as shown in FIGS. 1C and E, the bleached pulp exiting the tower can be further processed in, e.g., a secondary refiner. The high consistency retention tower 24 allows the chemical bleaching reactions carried over from chip pretreatment and refining to continue.

The presence of an ample amount of the alkaline peroxide chemicals in the primary refiner (e.g., as by shifting a large proportion of the chemical reactions to the refiner chemical treatment stage) improves efficiency. This is because variations in chip forms and quality, in addition to the natural heterogeneity of wood chips and fibers, often make it difficult, if not impossible, to achieve a good chemical distribution in the chip pretreatment/impregnation stage(s). In these situations, the mixing action at the primary refiner according to the invention helps considerably the chemical distribution, and hence, improves the chemical efficiency. Fast distribution of bleach chemicals such as peroxide to the chromophore sites is correlated with efficient bleaching. This efficiency is achieved because the targeted peroxide reactions are carried out at the reaction site of interest quickly without lengthy exposure to the heterogeneous environment present in the process. The primary refiner may conventionally have a temperature at the inlet between the plates that pushes the chromophore removal and hemicellulose alkali reactions so fast that that pH is lowered prematurely. Using the primary refiner as a combination chemical mixer and refiner according to the invention, distributes the chemicals fast enough to compete favorably against and counter to a significant extent, the elevated temperature that may be present in the refiner. This favorable distribution is in part, a consequence of the upstream conditioning of the chips in the screw press.

The discharged primary pulp should also be maintained at conditions that allow the desired chemical reactions to continue. The maintenance conditions include but are not limited to temperature, pressure, pH, chemical concentration, solids concentration, and time, that allow for bleaching of the pulp to continue and limit the degradation of the bleaching agent through reactions that are extraneous to the bleaching of the pulp. Such extraneous reactions may be non-productive, inefficient, and/or harmful to the bleaching of the pulp. Control of some and/or all of the conditions may or may not be needed depending on e.g., the type and condition of the lignocellulosic material used in the process, and the type, size and operating environment of the equipment itself. For example, conditions of temperature may be modified throughout the process by the addition of water, pressurized gas, and other heating or cooling methods. Temperature modifying means may be employed during transfer of the primary pulp 22 by using a mixing screw with water added while the pulp is mixed and transferred to the tower. The temperature of the primary pulp may also be thermally adjusted within the tower if the primary pulp is discharged directly to the tower 28, by means known in the art. For example, the pulp may be thermally adjusted through addition of liquids or gases, and/or through use of heat transfer components such as tubing, tower jacketing, etc. The method of discharge, either by blowing 20*a* from the pressurized refiner casing or by gravity discharge from the atmospheric casing 20, can be used to maintain and adjust the temperature of the primary pulp.

As used herein, the term "control" should be understood as including both active and passive techniques. Thus, control could be implemented by a static hardware configuration or by continually measuring one or more process parameters and controlling one or more process variables.

The chemical conditions present anywhere in the inventive process may be modified by additives to prevent extraneous degradation. This modification may be made at, by way of example, the pretreatment step(s) 1 and/or 2, the cross conveyer 10, the ribbon feeder 12, the inlet eye of the refiner disc 14, the plates of the refiner disc 16. An example of stabilizers would be chelation agents. A chelation agent refers to a compound that has an ability to form complexes, so called chelates, with metals occurring in the lignocellulosic material, and primary pulp. Such metals may include monovalent metals sodium and potassium, earth-alkali divalent metals calcium, magnesium and barium, and heavy metals such as iron, copper and manganese. The metal ions retained in the material as it is processed makes the bleaching by oxygen chemicals (such as hydrogen peroxide) less effective, and results in excess chemical consumption as well as other problems well known in the art. In order to reduce or eliminate the effect of these metal ions on the process, chelants such as for example diethylene triamine pentaacetic acid (DTPA), ethylene diamine tetraacetic acid (EDTA) and nitriletriacetic acid (NTA) may be used. These and other chelation agents known in the art may be used alone or in combination as needed or desired depending on process conditions. In addition, silcates and sulfates as examples may also be used advantageously as stabilizers as well as serving other functions well known in the art.

Further embodiments and aspects of the invention will be apparent from the examples and description set forth below.

ILLUSTRATIVE EXAMPLES

Example Set A

Three general series of pilot plant processes are illustrated in the following examples. The materials and conditions for the following examples, unless specified otherwise are:

Wood: A blend of 50% aspen and 50% basswood was used in this study. The aspen woods had rotten centers, which made it more difficult to bleach than normally expected. The woods were all from Wisconsin USA, and debarked, chipped and screened before further processing.

Chemical Impregnation: Chips were pre-steamed first for 10 minutes, and then pressed using an Andritz 560GS Impressafiner at 4:1 compression ratio before impregnated with alkaline peroxide chemical liquor. The chemical liquor was introduced at the discharge of the press, and allowed for 30 minutes retention time before refining.

Refining: An Andritz 92 cm (36") Model 401 double disc atmospheric refiner at a conventional speed of 1200 rpm was used for all the refining processes. There was 15 minutes or more retention time between the primary and the secondary, and no dilution after the primary and before the secondary. The refining consistency was 20% at both the primary and the secondary.

Pulp Testing: Tappi Standards were used for all pulp testing except for freeness, which follows Canadian Standard Freeness (CSF) test methods.

In the first of three processes compared, all of the alkaline chemicals were applied, (3.3% total alkalinity, (TA), and 2.4% $H_2O_2$, together with 0.2% DTPA, 0.07% $MgSO_4$ and 3% $Na_2SiO_3$) at the chip impregnation (preconditioning or pretreatment) stage, (only one stage chip impregnation was applied), then refined at atmospheric pressure. This series was, therefore, named "Chip". The second series used approximately two thirds of the total alkaline peroxide chemicals, (or 2.4% TA, 1.6% $H_2O_2$, 0.08% DTPA, 0.04% $MgSO_4$ and 2.4% $Na_2SiO_3$), at the chip impregnation stage, and approximately one third of the total chemicals, (1.0% TA, 1.0% $H_2O_2$, 0.19% DTPA, 0.05% $MgSO_4$, and 0.9% $Na_2SiO_3$), at the eye of the primary refiner. It is labeled as "Chip+Refiner", and represents the invention. In the third series, labeled "Refiner", the chips were first pressed using the same chip press as the first two series, and then all the alkaline peroxide chemicals, (4.2% TA, 3.3% $H_2O_2$, 0.36% DTPA, 0.11% $MgSO_4$, 4.3% $Na_2SiO_3$), were applied at the eye of the primary refiner. In all the series, the pulp from the primary was allowed 15 minutes retention under cover in drums, (which gave a temperature about 80-90° C.), before the second stage refining. There was no interstage washing.

FIG. 2 summarizes some of the process conditions and results from each series. The pulps are all from second stage refining. In peroxide bleaching of mechanical pulps, a lower $TA/H_2O_2$ ratio is in general preferred under higher temperature to prevent, or to reduce the possibility of alkali darkening reaction. For this reason, as shown in Table 1, the lowest $TA/H_2O_2$ ratio, 1.27, was use for "Refiner" series, the second lowest, 1.31, for "Chip+Refiner" series, and the highest, 1.37, for "Chip" series. In "Refiner" series, a larger amount of TA charge (4.2%) was used to prevent pH from dropping too fast and too low during refining because of the high temperature and the heat generated from refining energy. Reasonable amounts of residual peroxide and pH were maintained in each of the series, FIG. 2.

As to the chemistry, the main difference between "Chip" and "Chip+Refiner" series is that the latter is more aggressive in moving more alkaline peroxide chemicals to the refiner chemical treatment stage.

Figure 3:
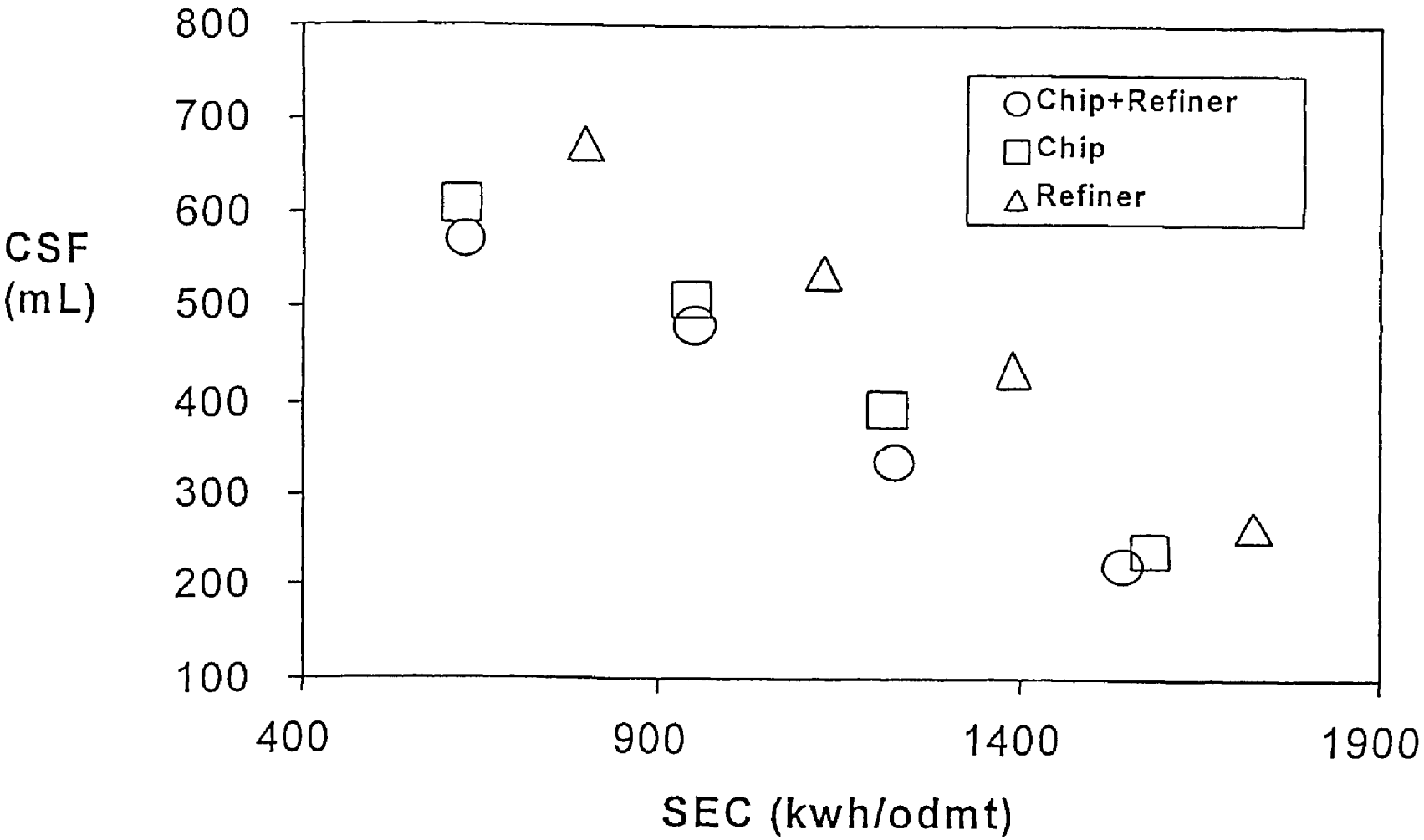
FIG. 3 is a graph of freeness as related to energy consumption for the invention and two prior art processes.

Graphic presentation of the data gathered from pulp after secondary refining after different investigated processes are shown in FIGS. 3 through 8. FIG. 3 shows effects of the different chemical applications on pulp freeness development in relation to specific energy consumption (SEC), which includes energy consumed during chip pretreatment stage. The "Chip+Refiner" series used slightly less SEC than the "Chip" series, but both series used, on average, approximately 200 kwh/odmt less SEC than the refiner bleaching series, "Refiner", even though the latter had more caustic chemicals applied than the first two series and has the same residual pH, 8.2, as "Chip+Refiner" series. It appears that adding the alkaline chemical under high temperature, at refiner eye, causes more alkali consumed on nonproductive, or side reactions that have little to do with pulp property, development.

It should be pointed out that in a commercial operation, the SEC in general is lower than that observed at the lab for chemical mechanical pulping of hardwoods. The SEC values in FIG. 3, therefore, are better used for comparison purpose than for their absolute values.

Figure 4:
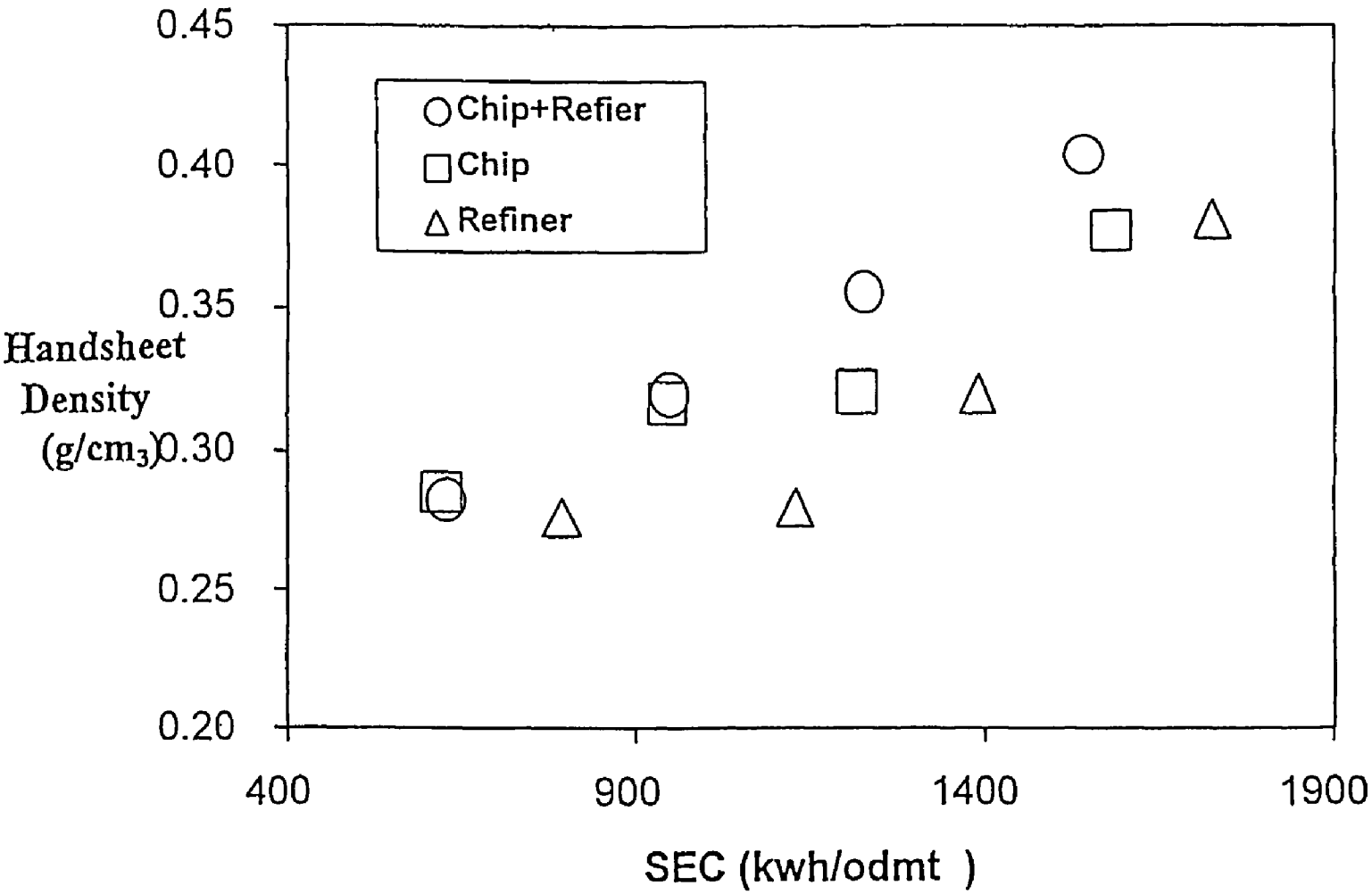
FIG. 4 is a graph of density as related to energy consumption for the invention and two prior art processes.

Because many pulp properties, especially the strength properties, are dependent on handsheet density, this property was also analyzed under SEC, and results are shown in FIG. 4. In this case, the more aggressive refiner chemical treatment P-RC APMP series, "Chip+Refiner", had the best efficiency for handsheet density development, which was followed by "Chip" and "Refiner" series. These results demonstrate that in chemical mechanical pulping, process energy efficiency depends not only on how much but also on how the chemicals are applied.

Figure 5:
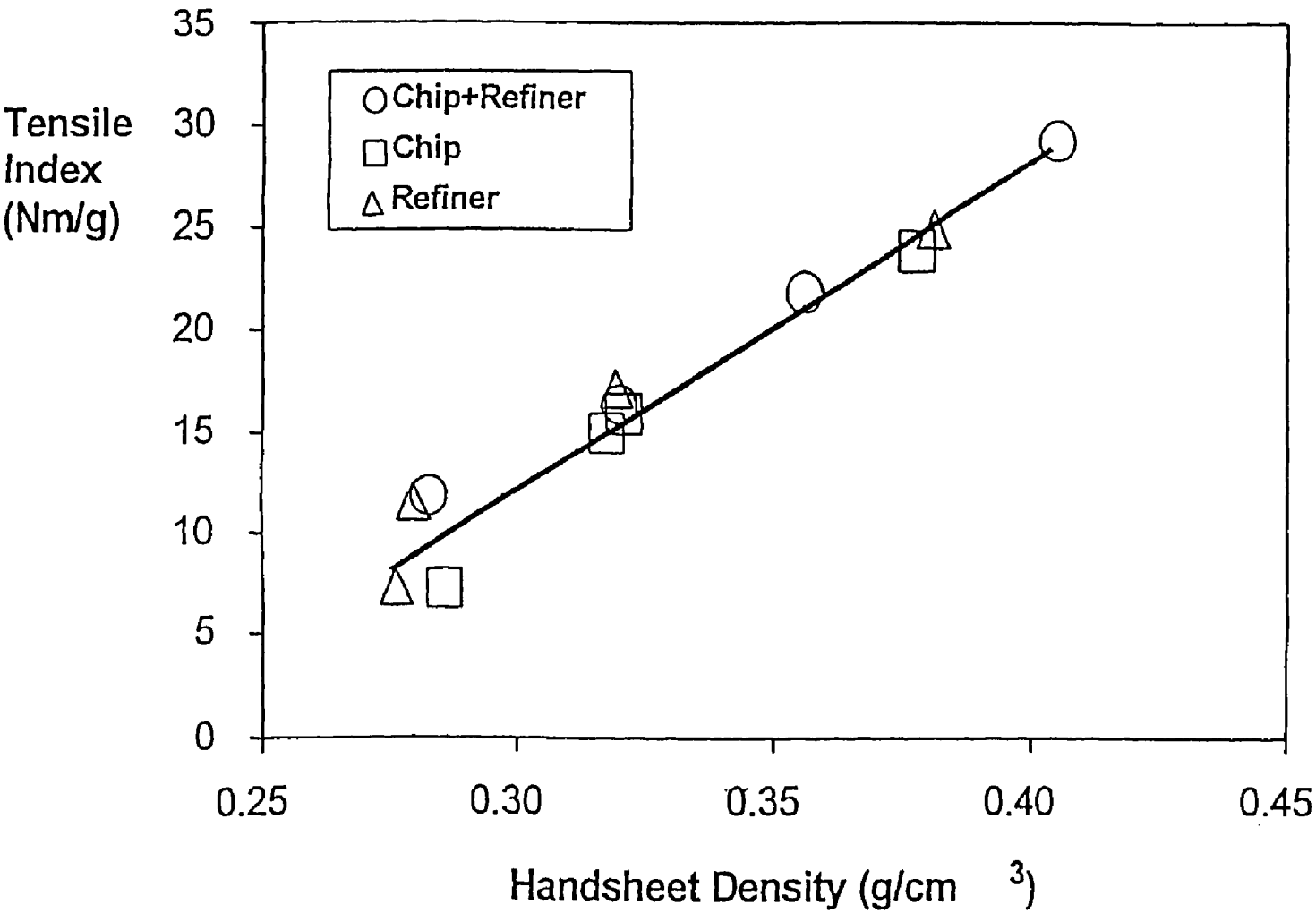
FIG. 5 is a graph of the tensile of tensile development for the invention and two prior art processes.
Figure 6:
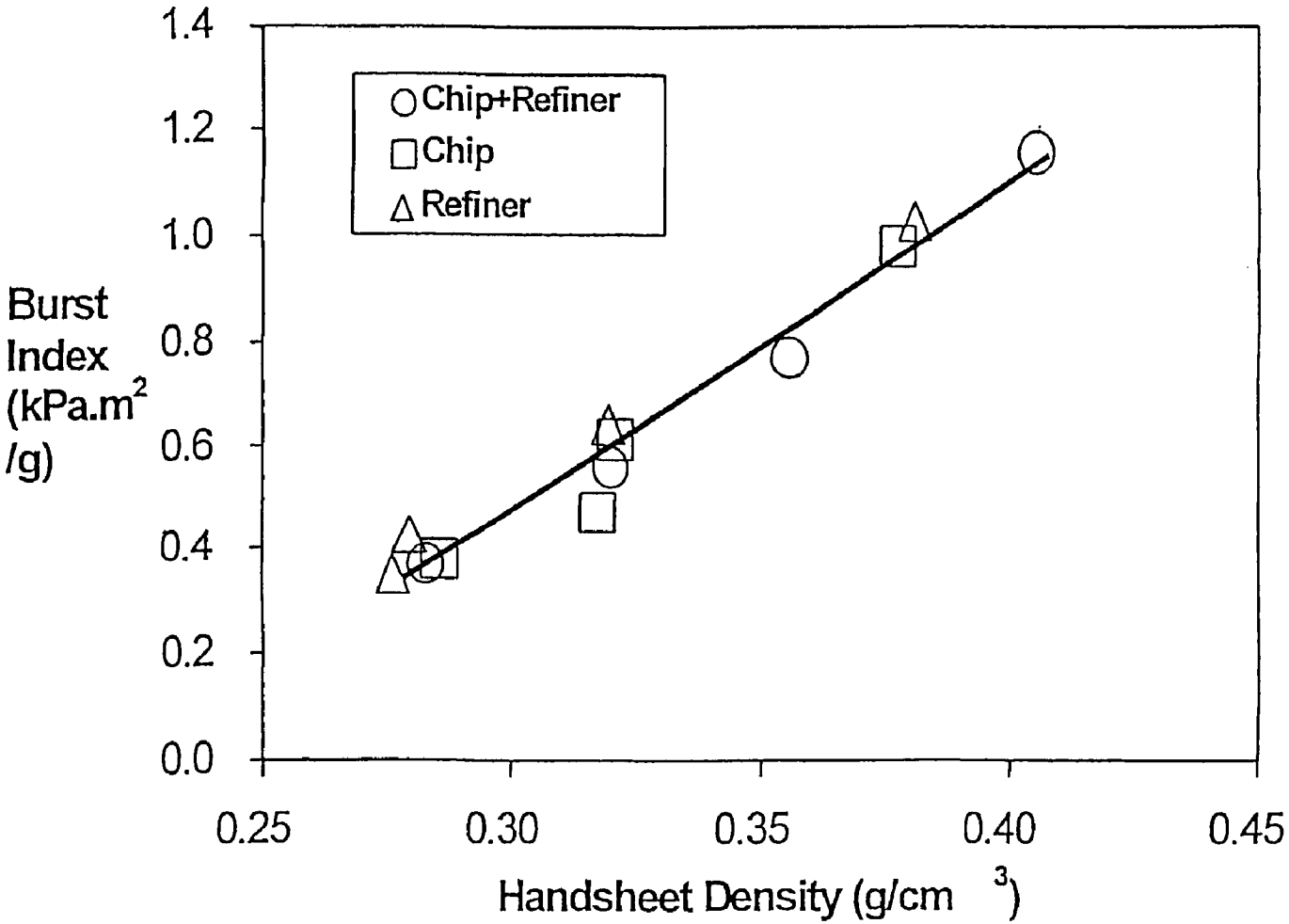
FIG. 6 is a graph of burst development for the invention and two prior art processes.

As for pulp intrinsic property development, there was however, little difference among the three series, as illustrated in FIGS. 5 and 6, suggesting that as long as the chemicals are added before refining, the mechanism involved in fiber strength property development remains the same.

Figure 7:
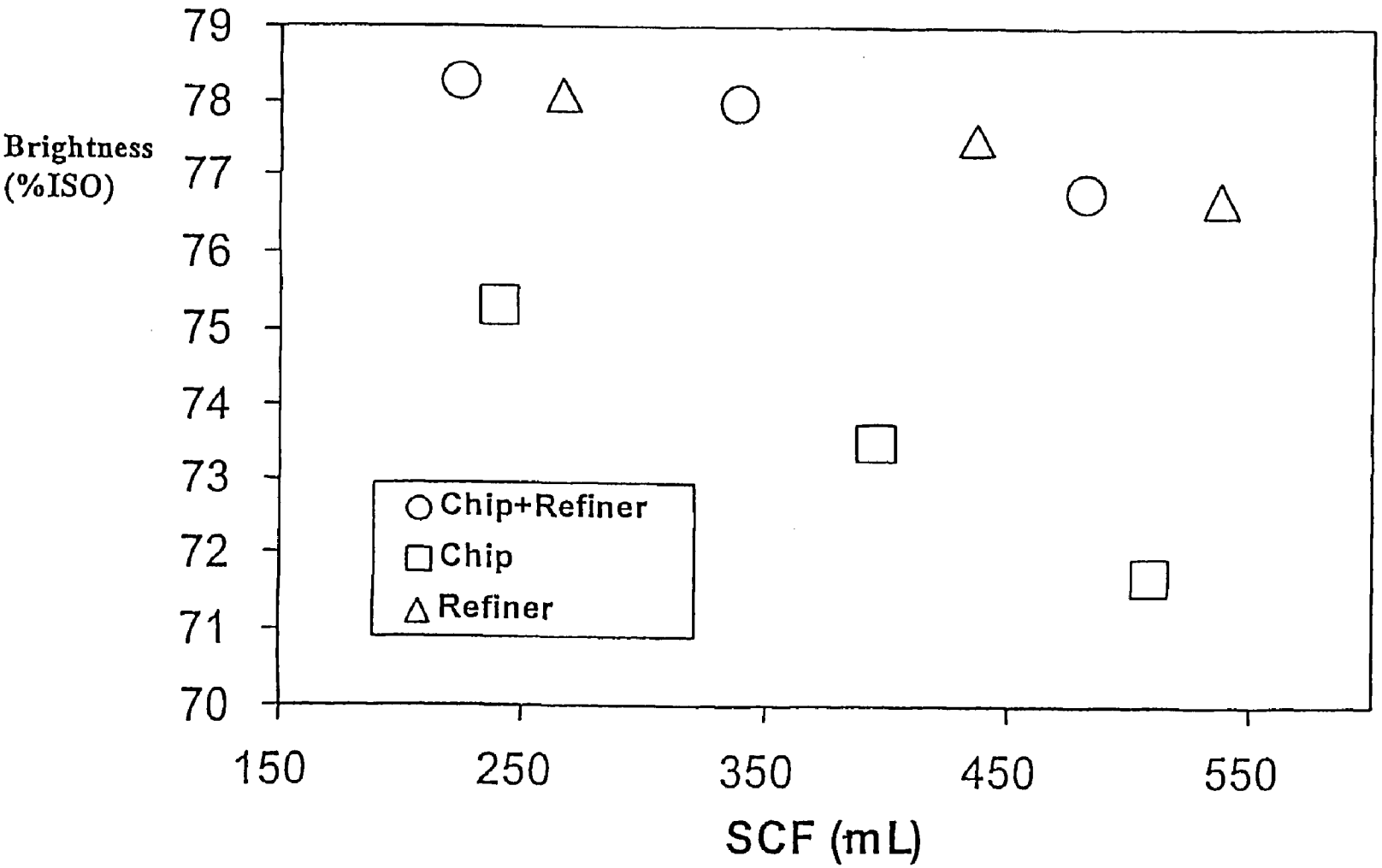
FIG. 7 is a graph of brightness development for the invention and two prior art processes.

As for pulp optical property development, in mechanical pulping, pulp brightness is often freeness-dependent. FIG. 7 shows brightness at different freeness from each series. Of interest is that "Chip+Refiner" series had a similar brightness development as that of the "Refiner" series, even though the former used less amount of the bleaching chemicals, 2.6% $H_2O_2$/3.4% TA versus 3.3% $H_2O_2$/4.2% TA. Adding all of the chemicals at the impregnation stage, "Chip" series, showed also a less bleaching efficiency, 2 or more points lower, than that of "Chip+Refiner" series. This suggests that the bleaching efficiency is sensitive to how the chemicals are distributed between the chip impregnation and refining in P-RC APMP process. In this case, a compromise between adding all of the chemicals at chip impregnation or at eye of refiner appears to be the most efficient in bleaching and peroxide consumption.

Figure 8:
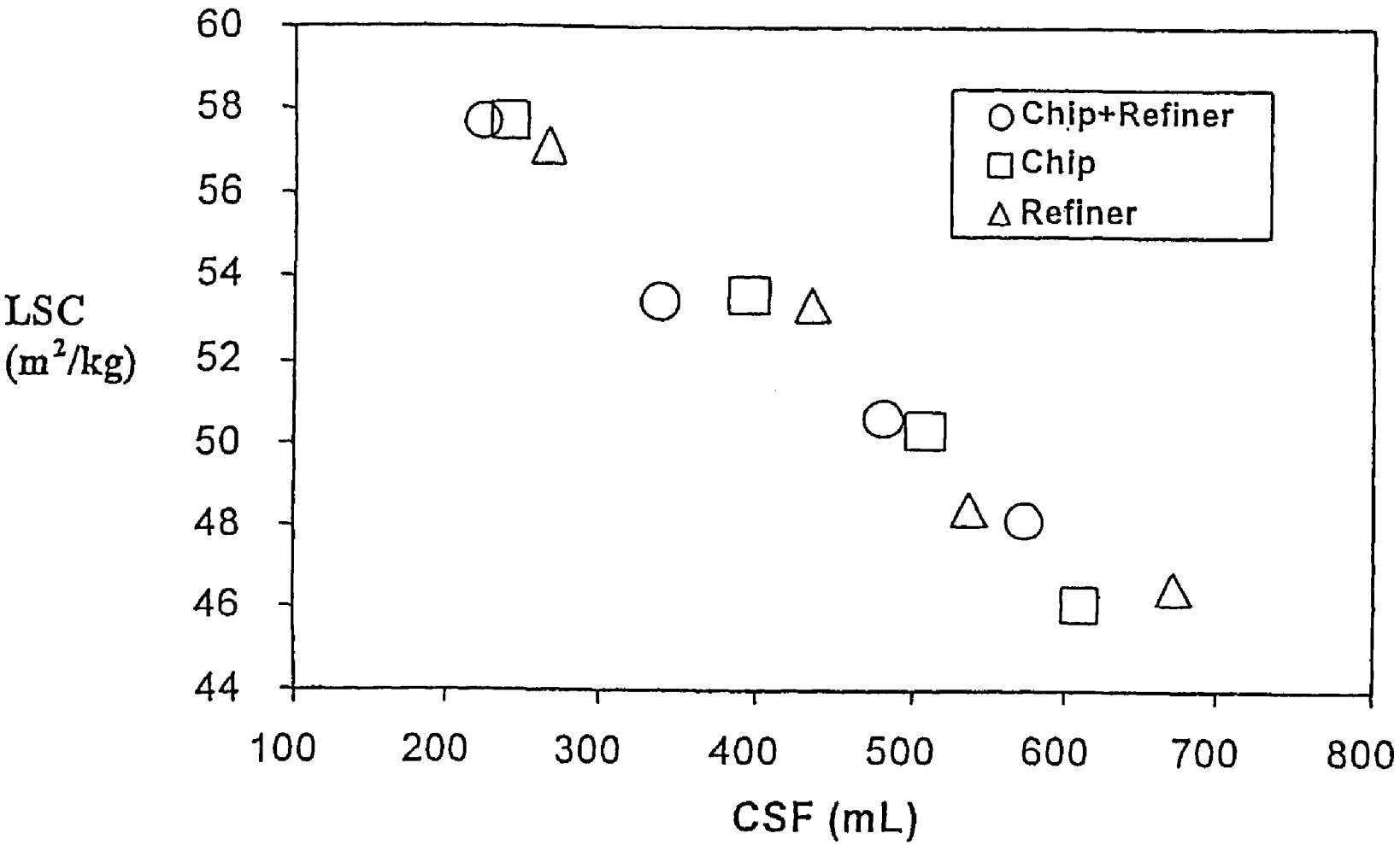
FIG. 8 is a graph of the light scattering coefficient of the pulp as a function of freeness for the invention and two prior art processes.

FIG. 8 shows that there was no difference in light scattering property development in all the series studied, suggest the pulp surface development mechanism also remain the same as long as the chemicals are added before refining.

Example Set B

The below examples illustrate a different refining configuration where the primary refiner was maintained at a negligible gauge pressure at the inlet and a low pressure (approximately 140 kPa) at the casing. Advantages of this configuration include:

1) better steam handling at the refiner discharge, especially for high capacity refiners (300 t/d or higher);

2) ease of transfer primary pulp from the refiner to the interstage high consistency (HC) tower;

3) a potential to use some of the steam generated from the primary refining (by using a cyclone to separate steam and pulp fiber);

4) ease of converting existing TMP systems into a P-RC APMP process.

These examples show that running the primary refiner at a low pressure (140 kPa) in the casing and atmospheric at the inlet can give similar bleaching efficiency as that of atmospheric at both the inlet and the casing. Temperatures at the inlet and between the plates in the primary refiner may push the chromophore removal and hemicellulose alkali hydrolysis reactions fast enough that pH was lowered considerably before the pulp reaches the casing out off the refiner plates. The pulps 10 at the cyclone discharge from the primary refiner were measured in the examples below to have pH of 9.3-9.7, at which peroxide is easy to stabilize even under the high temperatures (80-90° C.) observed.

The materials and conditions for the following examples below were as follows:

Wood: Aspen and birch chips from a commercial pulp mill in eastern Canada were used in this study.

Chip Impregnation: A conventional pilot chip impregnation system was used in this study. In all the P-RC APMP runs studied, only DTPA was used in the first stage of chip impregnation. The chips were then impregnated with alkaline peroxide (AP) chemicals at second stage impregnation. The AP treated chips were then allowed for 30 to 45 minutes' retention (without steaming) before being refined.

Atmospheric Refiner System: Andritz 36" diameter (92 cm) double disc 401 system is typically used for conventional P-RC APMP process investigations. This system consists of an open metering belt, an incline twin-screw feeder, the refiner and an open belt discharge. The system is used for both primary and later stages of refining. When used for the primary, the pulp discharged were collected in drums and kept under cover to maintain a high temperature (typically 80 to 90° C.) for a certain period of time.

Pressurized Refiner System: An Andritz single disc 36" diameter (92 cm) pressurized system was modified and used in this study for atmospheric inlet/pressurized casing configuration. The original refiner system has all the standard features of a conventional TMP system. In order to run the system with atmospheric pressure at the inlet, a valve was placed on top of the vertical steaming tube and was kept open during refining. During the trial, the plug screw feeder (PSF) was run at 50 rpm (normal speed for TMP is 10 to 20 rpm) to ensure the chemical impregnated chips were not compressed. The AP impregnated chips were placed in a chip bin, which discharged the chips into a blower. The chips were then blown to a cyclone and discharged to a conveyor, which feeds the PSF. The chips were then dropped into a vertical steam tube before being fed into the refiner. During refining, the primary refiner was controlled to have zero pressure at the inlet and 140 kPa in the casing. From the casing, the primary pulp was blown to a cyclone and discharged and collected in drums, and then treated similarly as in the atmospheric refining runs.

Pulp Tests: TAPPI standard was used for brightness tests. Peroxide residuals were measured using standard iodometric titration.

Running the primary refiner with pressurized casing and atmospheric inlet was compared with conventional atmospheric refining in P-RC APMP pulping of aspen and birch commercial wood chips. The results showed that both refining configurations gave similar bleaching efficiency. For some installations, using pressurized casing can significantly simplify the process, engineering and operation of P-RC APMP process.

FIG. 9 presents the chemical conditions used for P-RC APMP pulping of aspen, and brightness results from atmospheric and casing pressurized runs with the primary refiner. Applying similar AP chemical strategies in both cases, and having similar amounts of total chemical consumption (5.2 to 5.4% total alkali, TA, and 3.7 to 3.9% $H_2O_2$), both the atmospheric and the casing pressurized gave a similar brightness, achieving 84.2% ISO and 84.7% ISO respectively.

The residual pH (8.8-9.0) in both cases were slightly higher than ideal (approximately 7.0-8.5) and the $H_2O_2$ residual (1.5 to 2.0% on o.d. pulp) was also higher than normal (0.5 to 1.0%), suggesting that in both cases the pulp property could be further developed had the chemical treatments been further optimized.

It is worth pointing out that the bleaching efficiency shown in Table 1 (3.7 to 3.9% $H_2O_2$ and 5.2-5.4% TA consumption to reach 84.2 to 84.7% ISO brightness) is comparable to or better than bleaching efficiency normally observed in $H_2O_2$ bleaching of TMP or CTMP pulps from aspen.

FIG. 10 presents conditions and results from P-RC APMP pulping of the birch. This particular birch chips was slightly more difficult to bleach than the aspen. Using similar AP chemical strategies, the atmospheric and the pressurizing casing again gave similar bleaching efficiency: 3.1-3.2% TA and 3.4-3.6% $H_2O_2$ to reach 82.4 to 82.6% ISO brightness. In this case, the residual chemicals (0.1-0.2% TA, 0.5-0.6% $H_2O_2$ and pH of 8) were within ideal $H_2O_2$ bleaching conditions.

The invention claimed is:

1. An alkaline peroxide mechanical pulping process consisting of the steps of:

feeding a lignocellulosic material into a first press;

pressing the lignocellulosic material;

discharging the lignocellulosic material from the first press;

impregnating the lignocellulosic material discharged from the first press with a first alkaline peroxide pretreatment solution and maintaining the impregnation for a first reaction time;

feeding the lignocellulosic material impregnated with the first pretreatment solution to a refiner having an inlet and a rotating disc within a casing;

adding an alkaline peroxide refiner solution to the lignocellulosic material as it is fed to the refiner;

mixing the refiner solution and the lignocellulosic material with the refiner as the material is refined to a primary pulp;

delivering the primary pulp from the refiner casing to a high consistency tower;

retaining the primary pulp in the tower to produce bleached primary pulp; and further processing the bleached primary pulp to a secondary pulp.

2. The alkaline peroxide mechanical pulping process of claim 1 wherein the first pretreatment solution impregnation is at a temperature of about 0° C. to about 90° C. and is maintained for said first reaction of about 5 to about 45 minutes.

3. The alkaline peroxide mechanical pulping process of claim 1, wherein the first pretreatment solution comprises up to abut 0.5% chelation agent based on dried material weight, up to about 4% NaOH based on dried material weight, and up to about 4% $H_2O_2$ based on dried material weight, about 0% to about 4% sodium silicate based on dried material weight, and about 0% to about 2% $MgSO_4$ based on dried material weight.

4. The alkaline peroxide mechanical pulping process of claim 1, wherein the refiner solution comprises:

up to about 0.5% chelation agent based on dried material weight, up to about 4% NaOH based on dried material weight, and up to about 4% $H_2O_2$ based on dried material weight;

about 0% to about 4% sodium silicate based on dried material weight, and about 0% to about 2% $MgSO_4$ based on dried material weight.

5. The alkaline peroxide mechanical pulping process of claim 1, wherein the refiner has an atmospheric pressure at the inlet and the casing.

6. The alkaline peroxide mechanical pulping process of claim 1, wherein the refiner inlet is maintained at atmospheric pressure and the casing is maintained at a pressure above atmospheric.

7. The alkaline peroxide mechanical pulping process of claim 1, wherein the refiner casing is maintained at a gauge pressure of at least about 0.5 bar.

8. The alkaline peroxide mechanical pulping process of claim 1, wherein the step of delivering the primary pulp from the refiner casing to the high consistency tower further comprises cooling the primary pulp with water as it is delivered.

9. The alkaline peroxide mechanical pulping process of claim 1, wherein the step of delivering the primary pulp from the refiner casing to the high consistency tower is through a blow valve.

10. The alkaline peroxide mechanical pulping process of claim 1, wherein the refiner has a pressure above atmospheric at the inlet and a pressure above atmospheric in the casing.

11. The alkaline peroxide mechanical pulping process of claim 1, wherein the material is retained in the high consistency tower for a retention time of about 15 minutes.

12. The alkaline peroxide mechanical pulping process of claim 1, wherein the step of adding a refiner solution to the lignocellulosic material as it is fed to the refiner occurs at a cross conveyor between the first press and the refiner.

13. The alkaline peroxide mechanical pulping process of claim 1, wherein the step of adding a refiner solution to the lignocellulosic material as it is fed to the refiner occurs at a ribbon feeder at the refiner inlet.

14. The alkaline peroxide mechanical pulping process of claim 1, wherein the step of adding a refiner solution to the lignocellulosic material as it is fed to the refiner occurs at the inlet of the refiner plates.

15. The alkaline peroxide mechanical pulping process of claim 1, wherein the step of pressing the elignocellulosic material before impregnation with the first pretreatment solution is accomplished with the first press having a compression ratio of at least about 1.5:1.

16. The alkaline peroxide mechanical pulping process of claim 1, wherein the material at the first impregnation with the first impregnation solution is in the form of wood chips having a consistency of about 15% to about 50%.

17. An alkaline peroxide mechanical pulping process consisting of the steps of:

feeding a lignocellulosic material into a first press;

pressing the lignocellulosic material;

discharging the lignocellulosic material from the first press;

impregnating the lignocellulosic material discharged from the first press with a first alkaline peroxide pretreatment solution and maintaining the impregnation for a first reaction time;

feeding the lignocellulosic material that has been impregnated with the first pretreatment solution for a first reaction time, into a second press;

pressing and discharging the lignocellulosic material from the second press; and impregnating the lignocellulosic material discharged from the second press with a second alkaline peroxide pretreatment solution and maintaining the second impregnation for a second reaction time;

feeding the lignocellulosic material impregnated with the second pretreatment solution to a refiner having an inlet and a rotating disc within a casing;

adding an alkaline peroxide refiner solution to the lignocellulosic material as it is fed to the refiner;

mixing the refiner solution and the lignocellulosic material with the refiner as the material is refined to a primary pulp;

delivering the primary pulp from the refiner casing to a high consistency tower;

retaining the primary pulp in the tower to produce bleached primary pulp; and further processing the bleached primary pulp to a secondary pulp.

18. The alkaline peroxide mechanical pulping process of claim 17 wherein the second pretreatment solution impregnation is at a temperature of about 10° C. to about 80° C. maintained for said second reaction time of about 5 to about 60 minutes.

19. The alkaline peroxide mechanical pulping process of claim 17, wherein the second pretreatment solution comprises:

up to about 0.5% chelation agent based on dried material weight, about 0.5% to about 6%

NaOH based on dried material weight, about 0.5% to about 6% $H_2O_2$ based on dried material weight;

about 0% to about 4% sodium silicate based on dried material weight, and about 0% to about 2% $MgSO_4$ based on dried material weight.

20. The alkaline peroxide mechanical pulping process of claim 17, wherein the step of pressing the lignocellulosic material before impregnation with the second pretreatment solution is accomplished with the second press having a compression ratio of at least about 1.5:1.

21. The alkaline peroxide mechanical pulping process of claim 17, wherein the material is in the form of wood chips and the chips at the second impregnation with the second impregnation solution have a consistency of about 20% to about 50%.

22. The alkaline peroxide mechanical pulping process of claim 17, wherein the material at the first impregnation with the first impregnation solution is in the form of wood chips having a consistency of about 15% to about 50%, and the chips at the second impregnation with the second impregnation solution have a consistency of about 20% to about 50%.

23. An alkaline peroxide mechanical pulping process comprising consisting of the steps of:

feeding a lignocellulosic material into a first press;

pressing the lignocellulosic material;

discharging the lignocellulosic material from the first press;

impregnating the lignocellulosic material discharged from the first press with a first alkaline peroxide pretreatment solution and maintaining the impregnation for a first reaction time;

feeding the lignocellulosic material impregnated with the first pretreatment solution to a refiner having an inlet and a rotating disc within a casing;

adding an alkaline peroxide refiner solution to the lignocellulosic material at the refiner;

mixing the refiner solution and the lignocellulosic material with the refiner as the material is refined; and discharging the lignocellulosic material from the casing.

24. The alkaline peroxide mechanical pulping process of claim 23, wherein the material undergoes peroxide bleaching in the refiner and the material discharged from the casing continues undergoing peroxide bleaching during conveyance to a further processing step.

25. The alkaline peroxide mechanical pulping process of claim 23, wherein the material discharged from the casing is delivered to and retained in a high consistency bleaching tower, then further processed into a secondary pulp.

26. An alkaline peroxide mechanical pulping process consisting of the steps of:

feeding a lignocellulosic material into a first press;

pressing the lignocellulosic material;

discharging the lignocellulosic material from the first press;

impregnating the lignocellulosic material discharged from the first press with a first alkaline peroxide pretreatment solution and maintaining the impregnation for a first reaction time;

feeding the lignocellulosic material impregnated with the first pretreatment solution to a refiner having an inlet and a rotating disc within a casing;

adding an alkaline peroxide refiner solution to the lignocellulosic material at the refiner;

mixing the refiner solution and the lignocellulosic material with the refiner as the material is refined;

discharging the lignocellulosic material from the casing; and quenching the lignocellulosic material discharged from the casing to below about 80° C.

27. An alkaline peroxide mechanical pulping process consisting of the steps of:

feeding a lignocellulosic material into a first press;

pressing the lignocellulosic material;

discharging the lignocellulosic material from the first press;

impregnating the lignocellulosic material discharged from the first press with a first alkaline peroxide pretreatment solution and maintaining the impregnation for a first reaction time;

feeding the lignocellulosic material impregnated with the first pretreatment solution to a refiner having an inlet and a rotating disc within a casing;

adding an alkaline peroxide refiner solution to the lignocellulosic material as it is fed to the refiner;

mixing the refiner solution and the lignocellulosic material with the refiner as the material is refined to a primary pulp;

quenching the primary pulp to a temperature below about 80° C.;

delivering the primary pulp from the refiner casing to a high consistency tower;

retaining the primary pulp in the tower to produce bleached primary pulp; and further processing the bleached primary pulp to a secondary pulp.

28. An alkaline peroxide mechanical pulping process consisting of the steps of:

feeding a lignocellulosic material into a first press;

pressing the lignocellulosic material;

discharging the lignocellulosic material from the first press;

impregnating the lignocellulosic material discharged from the first press with a first alkaline peroxide pretreatment solution and maintaining the impregnation for a first reaction time;

feeding the lignocellulosic material impregnated with the first pretreatment solution to a refiner having an inlet and a rotating disc within a casing;

adding an alkaline peroxide refiner solution to the lignocellulosic material as it is fed to the refiner;

mixing the refiner solution and the lignocellulosic material with the refiner as the material is refined to a primary pulp;

delivering the primary pulp from the refiner casing to a high consistency tower through a blow valve and a mixing screw where water is added and mixed with the primary pulp is and thereby the temperature of the primary pulp is adjusted to below about 80° C.

retaining the primary pulp in the tower to produce bleached primary pulp; and further processing the bleached primary pulp to a secondary pulp.

29. An alkaline peroxide mechanical pulping process consisting of the steps of:

feeding a lignocellulosic material into a first press;

pressing the lignocellulosic material;

discharging the lignocellulosic material from the first press;

impregnating the lignocellulosic material discharged from the first press with a first alkaline peroxide pretreatment solution and maintaining the impregnation for a first reaction time;

feeding the lignocellulosic material that has been impregnated with the first pretreatment solution for a first reaction time, into a second press;

pressing and discharging the lignocellulosic material from the second press; and impregnating the lignocellulosic material discharged from the second press with a second alkaline peroxide pretreatment solution and maintaining the second impregnation for a second reaction time;

feeding the lignocellulosic material impregnated with the second pretreatment solution to a refiner having an inlet and a rotating disc within a casing;

adding an alkaline peroxide refiner solution to the lignocellulosic material as it is fed to the refiner;

mixing the refiner solution and the lignocellulosic material with the refiner as the material is refined to a primary pulp;

delivering the primary pulp from the refiner casing to a high consistency tower through a blow valve and a mixing screw where water is added and mixed with the primary pulp is and thereby the temperature of the primary pulp is adjusted to below about 80° C.

retaining the primary pulp in the tower to produce bleached primary pulp; and further processing the bleached primary pulp to a secondary pulp.

30. The alkaline peroxide mechanical pulping process of claim 29, wherein the refiner casing is maintained at a gauge pressure of at least about 0.5 bar.

31. A four stage alkaline peroxide mechanical pulping process consisting of the following steps:

(a) a first stage consisting of:

feeding a lignocellulosic material into a first press;

pressing the lignocellulosic material;

discharging the lignocellulosic material from the first press;

impregnating the lignocellulosic material discharged from the first press with a first alkaline peroxide pretreatment solution and maintaining the impregnation for a first reaction time;

(b) a second stage consisting of:

feeding the lignocellulosic material impregnated with the first pretreatment solution to a mechanical refiner having an inlet and a rotor within a casing;

adding an alkaline peroxide refiner solution to the lignocellulosic material at the refiner;

mixing the refiner solution and the lignocellulosic material with the refiner as the material is refined to a primary pulp which undergoes bleaching in the refiner, is discharged from the refiner casing at a temperature above 80° C., and contains a concentration of alkaline peroxide sufficient to continue bleaching of the primary pulp;

(c) a third stage consisting of:

quenching the discharged primary pulp to a temperature below about 80° C.; and (d) a fourth stage consisting of:

delivering the quenched primary pulp to a high consistency bleaching tower with sufficient concentration of alkaline peroxide to continue bleaching of the primary pulp;

retaining the primary pulp in the tower to produce bleached primary pulp without addition of alkaline or peroxide in the third or fourth stage.

32. A four stage alkaline peroxide mechanical pulping process consisting of:

(a) a first stage consisting of:

feeding a lignocellulosic material into a first press;

pressing the lignocellulosic material;

discharging the lignocellulosic material from the first press;

impregnating the lignocellulosic material discharged from the first press with a first alkaline peroxide pretreatment solution and maintaining the impregnation for a first reaction time;

feeding the lignocellulosic material that has been impregnated with the first pretreatment solution for a first reaction time, into a second press;

pressing and discharging the lignocellulosic material from the second press; and impregnating the lignocellulosic material discharged from the second press with a second alkaline peroxide pretreatment solution and maintaining the second impregnation for a second reaction time;

(b) a second stage consisting of:

feeding the lignocellulosic material impregnated with the second pretreatment solution to a mechanical refiner having an inlet and a rotor within a casing;

adding an alkaline peroxide refiner solution to the lignocellulosic material at the refiner;

mixing the refiner solution and the lignocellulosic material with the refiner as the material is refined to a primary pulp which undergoes bleaching in the refiner, is discharged from the refiner casing at a temperature above 80° C., and contains a concentration of alkaline peroxide sufficient to continue bleaching of the primary pulp;

(c) a third stage consisting of:

quenching the discharged primary pulp to a temperature below about 80° C.; and (d) a fourth stage consisting of:

delivering the quenched primary pulp to a high consistency bleaching tower with sufficient concentration of alkaline peroxide to continue bleaching of the primary pulp;

retaining the primary pulp in the tower to produce bleached primary pulp without addition of alkaline or peroxide in the third or fourth stage.

* * * * *